United States Patent [19]

Huffman

[11] 4,091,249

[45] May 23, 1978

[54] PRESSURE SENSITIVE ELECTRICAL SWITCH HAVING A SNAP ELEMENT

[75] Inventor: John William Huffman, Kettering, Ohio

[73] Assignee: Emerson Electric Co., St. Louis, Mo.

[21] Appl. No.: 730,136

[22] Filed: Oct. 6, 1976

[51] Int. Cl.[2] ..... H01H 35/34

[52] U.S. Cl. ..... 200/83 P; 200/83 J; 200/81 R

[58] Field of Search ..... 200/159 B, 83 P, 83 J, 200/83 R, 81 R

[56] References Cited

U.S. PATENT DOCUMENTS

| | | | |
|---|---|---|---|
| 2,704,551 | 3/1955 | Ralston | 200/83 P |
| 3,177,313 | 4/1965 | Klimak | 200/83 P |
| 3,378,656 | 4/1968 | Johnson | 200/83 P |
| 3,553,402 | 1/1971 | Hire | 200/83 P |
| 3,816,685 | 6/1974 | Fiore | 200/83 P |

*Primary Examiner*—Gerald P. Tolin

*Attorney, Agent, or Firm*—Biebel, French & Nauman

[57] ABSTRACT

A pressure sensitive electrical switch has a monostable snap disc which is deformed in response to the application of sufficient force. A pressure reducer transmits a force proportional to the pressure of a fluid. The reducer has an annular force transmitting ring which applies force to the snap disc along a circle which is substantially concentric with the disc. By changing the force reducer in a switch to one having a different diameter ring, the operating characteristics of the switch may be changed.

10 Claims, 5 Drawing Figures

PRESSURE SENSITIVE ELECTRICAL SWITCH HAVING A SNAP ELEMENT

BACKGROUND OF THE INVENTION

The present invention is directed to pressure sensitive electrical switches and, more particularly, to switches of the type having a snap element which changes shape rapidly at a predetermined pressure and causes the switching state to be altered.

Snap action elements are particularly suited for use with pressure sensitive switches since a force proportional to the pressure of fluid may be conveyed to a snap element by a simple linkage mechanism. The snap element will change shape rapidly after a desired threshold force is applied but will distort only minimally until the threshold level is reached. The snap element may be coupled to switch contacts in a variety of ways such that sharp make or break actuation will result. Generally, once the threshold force level is reached and the snap element "snapped", the force applied to the element will have to be reduced substantially below the threshold level before the element will snap back to its original shape.

A numbered of pressure sensitive electrical switches have utilized snap elements and provided for adjustment of precise actuation pressures by means of auxiliary spring elements which act on the snap elements in opposition to the force applied from the pressurized fluid. U.S. Pat. No. 3,535,480, issued Oct. 20, 1970, tö Bahniuk; U.S. Pat. No. 3,335,242, issued Aug. 8, 1967, to Johnson; and, U.S. Pat. No. 3,773,991, issued Nov. 20, 1973, to Krieger et al, are all of this type. The pressure sensitive switch shown in U.S. Pat. No. 3,573,410 issued Apr. 6, 1971, to Budzich et al, is somewhat similar in design except that the snap element is bistable and the spring member is not adjustable. In U.S. Pat. No. 3,553,402, issued Jan. 5, 1971, to Hire, a similar switch is shown in which the adjustable spring affects the snap action in only one direction.

In U.S. Pat. No. 3,890,477, issued June 17, 1975, to Saunders, means are provided to alter the shape of the snap element slightly in a pressure sensitive switch and thus change the force level required to cause actuation.

U.S. Pat. No. 2,704,551 issued Mar. 22, 1955, to Ralston, shows a pressure sensitive valve mechanism with a snap element controlling opening and closing of the valve. The snap element shown in this device is generally in the shape of a truncated cone with the distorting force applied along the edge of the narrowed truncated portion.

As shown in U.S. Pat. No. 3,676,817, issued July 11, 1972, to Bletz, and U.S. Pat. No. 3,602,863, issued Aug. 31, 1971, to Place, snap elements have been used with temperature sensitive electrical switches as well. Additionally springs are typically used in such devices to adjust the temperature at which the bi-metal snap mechanisms distort.

Heretofore, to alter the threshold pressure for actuation of a snap element type of pressure sensitive electrical switch, a different snap element having a different force level requirement could be inserted in the switch or, alternatively, an adjustable, auxiliary spring mechanism could be provided. Neither alternative has proven to be completely acceptable. Snap elements which are dimensionally interchangeable but which differ in operating characteristics are not readily available for a large range of operating forces. The use of an auxiliary spring mechanism may adversely affect the snapping action of the snap element.

SUMMARY OF THE INVENTION

A pressure responsive electrical switching device includes a fluid inlet means and an adjacent pressure reducer means having a pressure receiving surface. The pressure reducer means also includes an annular force transmitting ring. A snap disc is positioned in contact with the force transmitting ring along a circle which is substantially concentric with the disc. The snap disc is movable from a first state in which it is convex toward the pressure reducer means to a second state in which it is concave, in response to transmission of sufficient force to the disc. A switch means is operatively connected to the snap disc and assumes first and second electrical switching states in response to the state of the snap disc. The switch means may include electrical contacts and a plunger means which is in contact with the snap disc when the snap disc is in its second state. Alternatively, the snap disc may act directly on the contacts.

Accordingly it is an object of the present invention to provide a pressure responsive electrical switching device having a snap element and a pressure reducer means for transmitting force to a specific location on the element; to provide such a switching device in which the points for force transmission to the snap element may be altered by substitution of different pressure reducer means, thereby altering the threshold switching pressure; and, to provide such a switch in which force is transmitted to a snap disc along a circle substantially concentric with the disc.

Other objects and advantages of the invention will be apparent from the following description, the accompanying drawings and the appended claims.

DETAILED DESCRIPTION OF THE PREFERRED EMBODIMENTS

Figure 2:
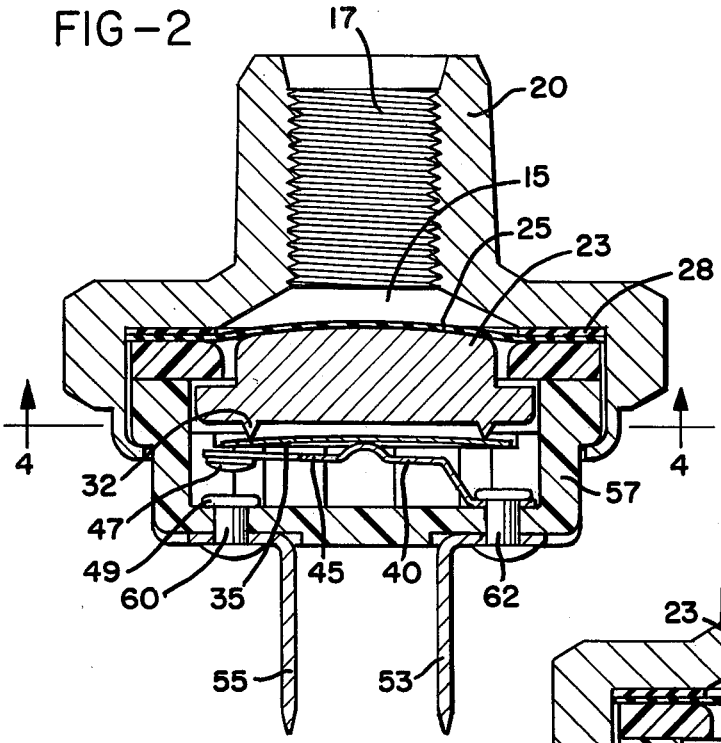
FIG. 2 is a sectional view taken generally on line 2—2 in FIG. 1.
Figure 1:
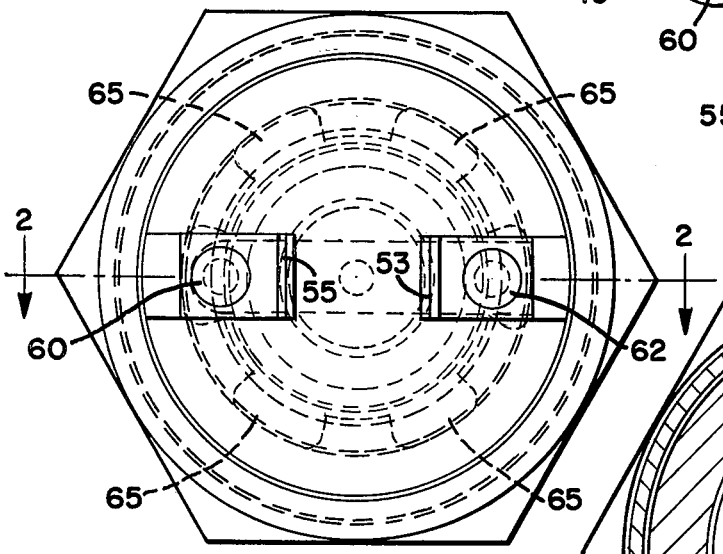
FIG. 1 is a plan view of the switch device of the present invention.

FIGS. 1 and 2 show the pressure responsive switch of the present invention before it is actuated. An inlet means 15 for receiving pressurized fluid may comprise a threaded opening 17 in switch casing 20. Typically, the threaded opening 17 will receive a hydraulic or pneumatic fitting and provide a sealed coupling. A pressure reducer means 23 has a pressure responsive area or surface 25 which is positioned adjacent the inlet means 15. A nonpermeable membrane 28 seals the inlet means such that no fluid will pass into the body of the switch.

The membrane will advantageously be of high elasticity, and will transmit substantially all of the pressure from the fluid to the pressure receiving surface 25. The pressure reducer means 23 additionally has a disc actuating means in the shape of an annular force transmitting ring 32. A snap disc means 35 is mounted peripherally and contacts the ring 32 along a circle which is generally concentric with the disc means 35. The disc is monostable in that, in the absence of external force, it will assume the shape shown in FIG. 2 in which it is slightly convex toward the pressure reducer means 23.

Figure 3:
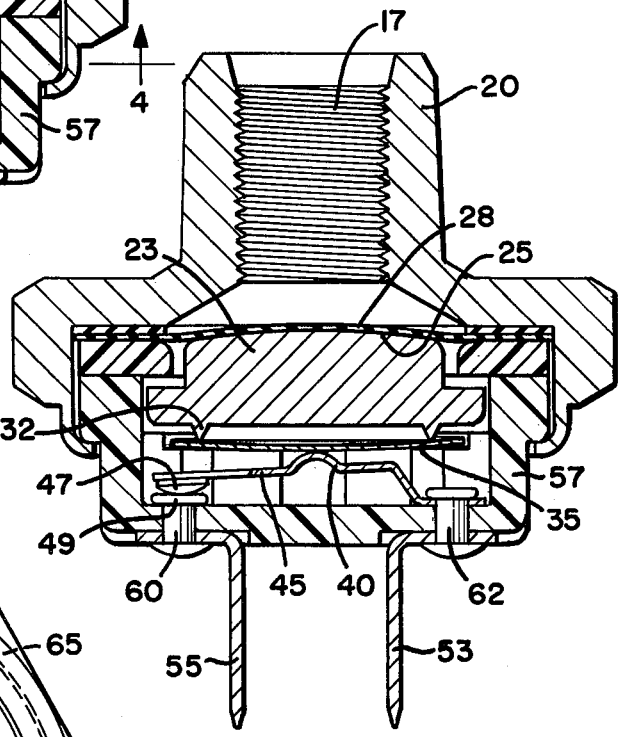
FIG. 3 is a sectional view, similar to FIG. 2, showing the elements of the switch after actuation.

Pressure reducer means 23 will transmit a force to the snap disc means 35 which is proportional to the pressure of the fluid at the inlet means 15. When a sufficient threshold force is applied to snap disc means 35, it will move rapidly into a second state in which a first surface of the disc, facing the reducer 23, becomes concave as seen in FIG. 3. When the disc moves into this second state, its second surface, opposite the first surface, presses against portion 40 of leaf spring 45 which forms a part of contact 47. Electrical contacts 47 and 49 are thus closed. Thus it is seen that the switch means is responsive to the snap disc and assumes first and second switch states in response to the state of the snap disc means. Electrical connectors 53 and 55 are attached to nonconducting casing 57 by rivets 60 and 62. Rivet 62 forms the second contact for the switching mechanism. As seen in FIG. 1, the lower interior surface 65 of casing 57 is scalloped to reduce the material needed and, additionally, to provide areas in which spring 40 may be attached to rivet 62 and contacts 47 and 49 may operate.

Figure 4:
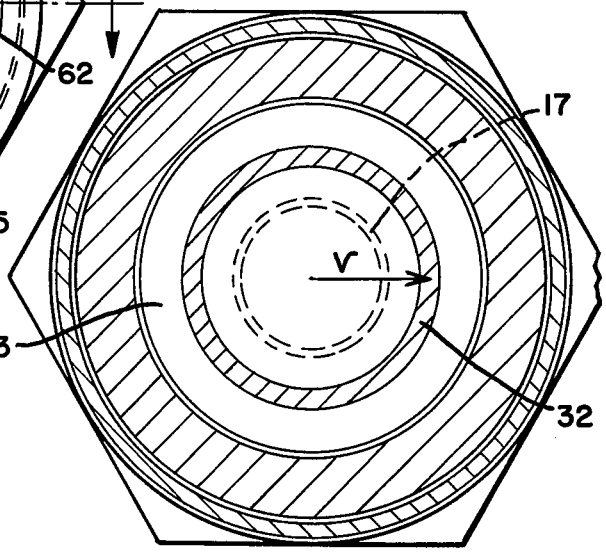
FIG. 4 is a sectional view taken generally along line 4—4 in FIG. 2.

Referring now to FIG. 4, a sectional view taken generally on line 4—4 of FIG. 2, the annular shape of the force transmitting disc actuating means is shown. One advantage with such a configuration is that pressure reducers, otherwise identical but having rings of differing radius *r*, may be substituted in a pressure responsive switch, with the result that the threshold pressure for the switch is altered. The following is a table illustrating the manner in which actuation pressure was found to vary with ring diameter. These measurements were made with a 0.915 inch diameter pressure receiving surface.

| Pressure Point | Close Pressure | Open Pressure |
|---|---|---|
| Center of disc | 14 p.s.i. | 5 p.s.i. |
| .637 inch ring diameter | 25 p.s.i. | 11 p.s.i. |
| .736 inch ring diameter | 40 p.s.i. | 15 p.s.i. |

It is apparent that the force receiving area of the reducer should affect the actuation pressure of the switch since the force applied to the disc will be equal to the pressure times the area of this surface, assuming a totally elastic membrane. This is confirmed by the following measurements, all of which were made with a 0.763 force transmitting ring diameter.

| Effective Diameter | Close Pressure | Open Pressure |
|---|---|---|
| .825 inch | 49 p.s.i. | 12 p.s.i. |
| .915 inch | 40 p.s.i. | 10 p.s.i. |

Figure 5:
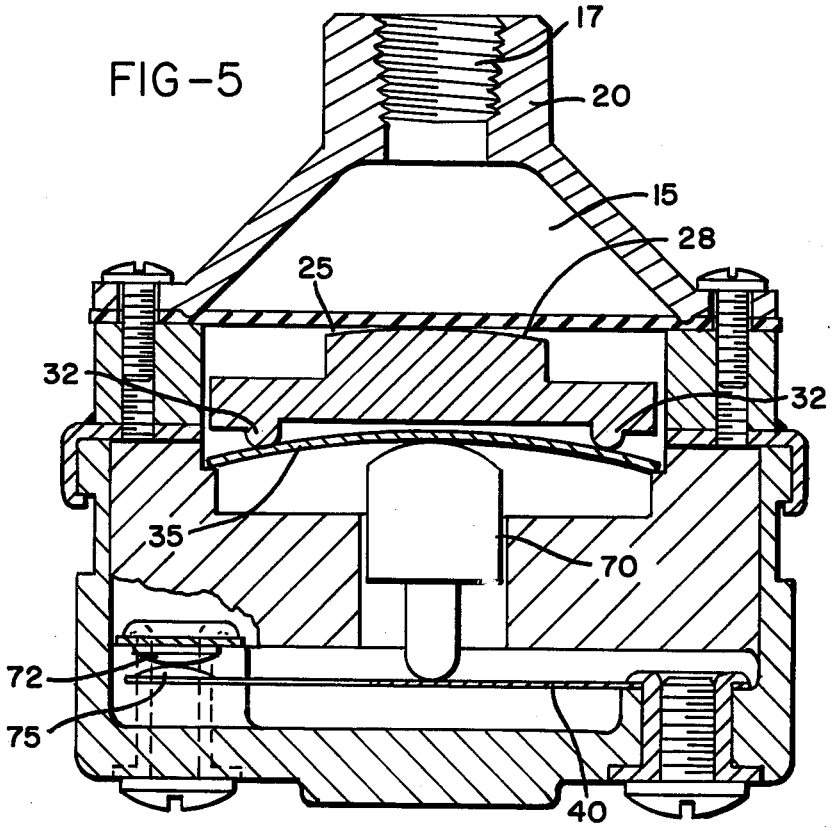
FIG. 5 is an axial sectional view, similar to FIG. 2 of an alternative embodiment of the invention.

Referring now to FIG. 5, a sectional view similar to FIG. 2 of a modified form of the present invention is shown. Many of the elements of this device are the same as the switch shown in FIG. 2, and these elements have been numbered. The principal difference in the device shown in FIG. 5 is that the snap disc 35 does not impinge directly on the contact spring 40. In the embodiment of FIG. 5, piston 70 is pushed downward by snap disc 35 when the snap disc moves into its second state. Piston 70 thereby causes the change in switch state. As illustrated in FIG. 5, the contacts 72 and 75 may also be arranged such that they are normally closed and opened in response to switch actuation. Alternatively, a double pole switching arrangement may be used in which a pair of contacts are positioned on either side of contact 75 such that one of the pair of contacts will be in contact with contact 75 in the two switching states.

While the forms of apparatus herein described constitute preferred embodiments of the invention, it is to be understood that the invention is not limited to these precise forms of apparatus, and that changes may be made therein without departing from the scope of the invention.

What is claimed is:

1. A pressure responsive electrical switching device for changing switching state in response to fluid pressure changes, comprising:

inlet means for receiving fluid, pressure responsive means of predetermined area, adjacent said inlet means, for transmitting a force in response to the pressure of the fluid, snap disc means peripherally mounted and actuatable from a first state in which a first surface of said snap disc means is convex to a second state in which said first surface is concave, disc actuating means, contacting said snap disc means on said first surface only at points positioned outwardly from the center of said snap disc means by a predetermined radius, for receiving a force transmitted by said pressure responsive means and for applying said force to said snap disc means, and, switch means, responsive to the movement of the center of said snap disc means as said disc means assumes said first state or said second state, for assuming first or second switching states, respectively.

2. The switching device of claim 1 in which said disc actuating means contacts said snap disc means along a circle substantially concentric with said snap disc means.

3. The switching device of claim 2 in which a second surface of said snap disc means, opposite said first surface, is contacted by said switch means substantially at the center of said second surface and said switch means is urged into its said second state when said snap disc means assumes its said second switching state.

4. The switching device of claim 2 in which said snap disc means includes a second surface which is opposite said first surface, said switching device further including a plunger positioned between said snap disc means and said switch means, and in which said plunger contacts said second surface of said snap disc means substantially at the center of said second surface.

5. The switching device of claim 1 in which said pressure responsive means includes an elastic diaphragm extending adjacent said inlet means for preventing fluid received into said inlet means from flowing past said diaphragm into said switching device.

6. The switching device of claim 5 in which the force transmitted by said pressure responsive means is proportional to said predetermined area, whereby the force applied to said snap disc means by said disc actuating means is a function of said predetermined area.

7. The switching device of claim 3 in which said switching means includes:

a first fixed electrical contact, a second movable electrical contact, conductive leaf spring means mounting said second movable electrical contact, and first and second electrical connectors connected to said first fixed electrical contact and to said conductive leaf spring means, respectively, whereby said first and second electrical contacts are closed and electrical connection is made between said first and second electrical connectors when said switch means is in its said second state.

8. A pressure responsive electrical switching device for changing switching state in response to pressure changes in a fluid, comprising:

inlet means for receiving the fluid, pressure reducer means having a pressure receiving surface adjacent said inlet means and an annular force transmitting ring, a snap disc in contact with said force transmitting ring along a circle substantially concentric with said disc, said snap disc being movable from a first state in which said disc in convex toward said pressure reducer means to a second state in which said snap disc is concave toward said pressure reducer means in response to the transmission of sufficient force to said disc by said ring, and switch means, operatively responsive to the movement of the center of said snap disc as said snap disc assumes one of said first and second states, for assuming first and second electrical switching states.

9. The switching device of claim 8 in which said switch means comprising:

electrical contacts, and a plunger means, in contact with said snap disc substantially at the center of said snap disc, for opening said contacts when said snap disc is in said second state.

10. The switching device of claim 8 in which said switch means comprises a set of electrical contacts, one of said contacts including a leaf spring which biases said set of electrical contacts apart, and in which said snap disc contacts said leaf spring substantially at the center of said snap disc when said snap disc is in its said second state such that said set of contacts is thereby brought together.

* * * * *